US006217163B1

(12) United States Patent
Anagnostopoulos et al.

(10) Patent No.: US 6,217,163 B1
(45) **Date of Patent: *Apr. 17, 2001**

(54) CONTINUOUS INK JET PRINT HEAD HAVING MULTI-SEGMENT HEATERS

(75) Inventors: Constantine N. Anagnostopoulos, Mendon; James M. Chwalek, Pittsford; Gilbert A. Hawkins, Mendon, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/221,342

(22) Filed: Dec. 28, 1998

(51) Int. Cl.[7] ..... B41J 2/02
(52) U.S. Cl. ..... 347/75
(58) Field of Search ..... ; 347/75, 77, 82, 347/56; 239/4, 102.1; B41J 2/02, 2/09

(56) References Cited

U.S. PATENT DOCUMENTS

| | | | |
|---|---|---|---|
| 1,941,001 | 12/1933 | Hansell | 347/75 |
| 3,287,734 | 11/1966 | Kazan | 347/75 |
| 3,709,432 | 1/1973 | Robertson | 347/75 |
| 3,878,519 | 4/1975 | Eaton | 347/75 |
| 3,893,623 | 7/1975 | Toupin | 347/75 |
| 4,070,679 | 1/1978 | Fan et al. | 347/75 |
| 4,283,730 | 8/1981 | Graf | 347/75 |
| 4,286,274 | 8/1981 | Shell et al. | 347/75 |
| 4,540,990 | 9/1985 | Crean | 347/75 |
| 4,631,550 | 12/1986 | Piatt et al. | 347/75 |
| 4,658,269 | 4/1987 | Rezanka . | |
| 4,994,821 | 2/1991 | Fagerquist | 347/75 |
| 5,122,814 * | 6/1992 | Endo et al. | 347/56 |
| 5,521,621 | 5/1996 | Endo et al. . | |
| 5,966,154 * | 10/1999 | Deboer | 347/82 |
| 6,012,805 * | 1/2000 | Hawkins et al. | 347/77 |
| 6,019,457 * | 2/2000 | Silverbrook | 347/65 |

FOREIGN PATENT DOCUMENTS

| | | |
|---|---|---|
| 2 041 831 | 9/1980 | (GB) . |
| 635185 | 2/1962 | (IT) . |
| 56-21866 | 2/1981 | (JP) . |
| 59-073964 | 4/1984 | (JP) . |
| 6-064161 | 3/1994 | (JP) . |

* cited by examiner

*Primary Examiner*—N. Le
*Assistant Examiner*—Judy Nguyen
(74) *Attorney, Agent, or Firm*—Milton S. Sales

(57) ABSTRACT

To compensate for droplet placement errors, a continuous ink jet printer includes a heater having a plurality of selectively independently actuated sections which are positioned along respectively different portions of the nozzle bore's perimeter. An actuator selectively activates none, one, or a plurality of the heater sections such that: actuation of heater sections associated with only a portion of the entire nozzle bore perimeter produces an asymmetric application of heat to the stream to control the direction of the stream between a print direction and a non-print direction, and simultaneous actuation of different numbers of heater sections associated with only a portion of the entire nozzle bore perimeter produces corresponding different asymmetric application of heat to the stream to thereby control the direction of the stream between one print direction and another print direction.

13 Claims, 7 Drawing Sheets

CONTINUOUS INK JET PRINT HEAD HAVING MULTI-SEGMENT HEATERS

CROSS REFERENCE TO RELATED APPLICATIONS

Reference is made to commonly assigned, U.S. patent application Ser. No. 08/954,317 entitled CONTINUOUS INK JET PRINTER WITH ASYMMETRIC HEATING DROP DEFLECTION filed in the names of Chwalek, Jeanmaire, and Anagnostopoulos on Oct. 17, 1997 now U.S. Pat. No. 6,079,821.

FIELD OF THE INVENTION

This invention relates generally to the field of digitally controlled printing devices, and in particular to continuous ink jet print heads which integrate multiple nozzles on a single substrate and in which the breakup of a liquid ink stream into droplets is caused by a periodic disturbance of the liquid ink stream.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high quality color images at a high-speed and low cost, using standard paper.

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet. Continuous ink jet printing dates back to at least 1929. See U.S. Pat. No. 1,941,001 to Hansell.

Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. U.S. Pat. No. 3,878,519, which issued to Eaton in 1974, discloses a method and apparatus for synchronizing droplet formation in a liquid stream using electrostatic deflection by a charging tunnel and deflection plates.

U.K. Patent Application GB 2 041 831A discloses a mechanism in which a deflector steers an ink jet by the Coanda (wall attachment) effect. The degree of deflection can be varied by moving the position of the deflector or by changing the amplitude of perturbations in the jet.

In commonly assigned, co-pending U.S. patent application Ser. No. 08/954,317 entitled CONTINUOUS INK JET PRINTER WITH ASYMMETRIC HEATING DROP DEFLECTION filed in the names of Chwalek, Jeanmaire, and Anagnostopoulos on Oct. 17, 1997, now U.S. Pat. No. 6,079,821, an ink jet printer includes a delivery channel for pressurized ink to establish a continuous flow of ink in a stream flowing from a nozzle bore. A heater having a selectively-actuated section associated with only a portion of the nozzle bore perimeter causes the stream to break up into a plurality of droplets at a position spaced from the heater. Actuation of the heater section produces an asymmetric application of heat to the stream to control the direction of the stream between a print direction and a non-print direction.

It was also disclosed in the above-cited co-pending application that, using semiconductor VLSI fabrication processes and equipment, and by incorporating addressing and driving circuits on the same silicon substrate as the nozzles, a dense linear array of nozzles can be produced. Such arrays can be many inches long and contain thousands of nozzles, thus eliminating the need to scan the print head across the page. In addition, ink jet printers may contain multiple arrays, all of which may be located on the same silicon substrate. Each array could then emit a different color ink. Full width and full color ink jet printers can thus be manufactured, which can print at high speeds and produce high quality color prints.

DISCLOSURE OF THE INVENTION

In graphic arts printing systems it is required that the droplets land extremely accurately on the specified locations, because of the high quality images expected from such systems. Many factors influence drop placement, such as air turbulence or non-uniform air currents between the print head and the receiver, varying resistance of the heaters or other manufacturing defects that affect droplet deflection.

It is therefore desirable to compensate for droplet placement errors. Such methods may include elimination of turbulence and more uniform air currents, higher velocity drops, more uniform heater resistance, etc.

Accordingly, it is a feature of the present invention to provide apparatus for controlling ink in a continuous ink jet printer including an ink delivery channel; a nozzle bore which opens into the ink delivery channel to establish a continuous flow of ink in a stream; a heater having a plurality of selectively independently actuated sections which are positioned along respectively different portions of the nozzle bore's perimeter. An actuator selectively activates none, one, or a plurality of the heater sections such that: actuation of heater sections associated with only a portion of the entire nozzle bore perimeter produces an asymmetric application of heat to the stream to control the direction of the stream between a print direction and a non-print direction, and simultaneous actuation of different numbers of heater sections associated with only a portion of the entire nozzle bore perimeter produces corresponding different asymmetric application of heat to the stream to thereby control the direction of the stream between one print direction and another print direction.

It is another feature of the present invention to provide a print head having an actuator adapted to selectively activate the heater sections such that the stream is selectively directed: in a non-print direction, in a first print direction, in a second print direction, and in a third print direction between the first and second print directions.

It is another feature of the present invention to provide a print head wherein the heater has three selectively independently actuated sections which are positioned along respectively left, center, and right portions of the nozzle bore perimeter, and the actuator is adapted to selectively activate no heater section, the left and center heater sections simultaneously, the center heater section alone, and the center and right heater sections simultaneously such that: actuation of no heater section directs the stream in the non-print direction, simultaneous actuation of the left and center heater sections directs the stream in the first print direction, simultaneous actuation of the center and right heater sections directs the stream in the second print direction, and actuation of the center heater section alone directs the stream in the third print direction between the first and second print directions.

It is another feature of the present invention to provide a print head having a plurality of nozzle bores, the nozzle bores being spaced apart from left to right in accordance with the predetermined resolution. Each nozzle bore has a heater having selectively independently actuated sections which are positioned along the nozzle bore perimeter; and an actuator adapted to selectively activate the heater sections such that the stream from a given nozzle bore is selectively directed: in a non-print direction, in a first print direction to produce a spot on the receiver aligned with the nozzle bore adjacent to one side of the given nozzle bore, in a second print direction to produce a spot on the receiver aligned with the nozzle bore adjacent to the other side of the given nozzle bore, and in a third print direction to produce a spot on the receiver aligned with the given nozzle.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
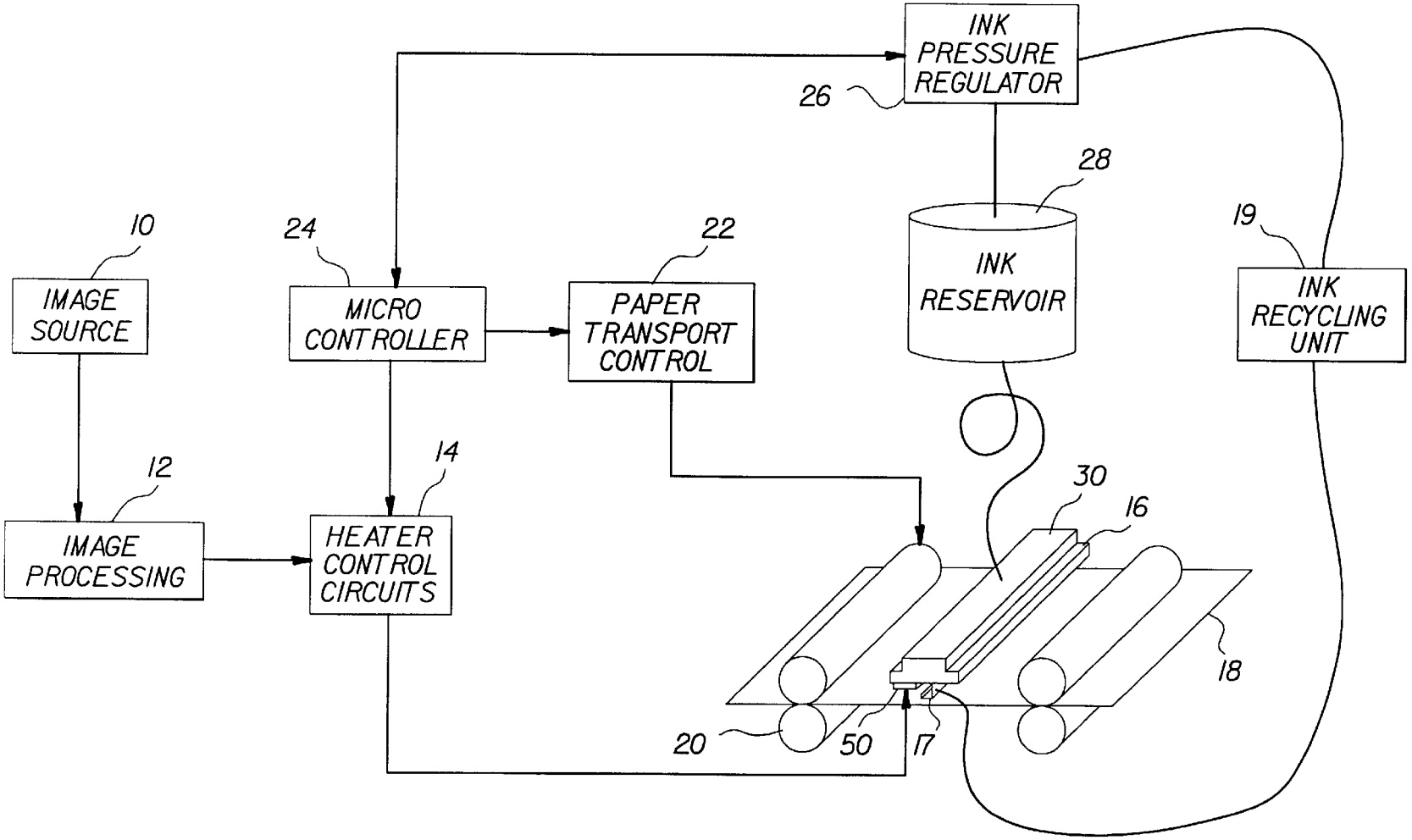
FIG. 1 shows a simplified block schematic diagram of one exemplary printing aparatus according to the present invention.

Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a set of nozzle heaters 50 that are part of a print head 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to print head 16 by a recording medium transport system 20, which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width print heads, it is most convenient to move recording medium 18 past a stationary print head. However, in the case of scanning print systems, it is usually most convenient to move the print head along one axis (the sub-scanning direction) and the recording medium along an orthogonal axis (the main scanning direction) in a relative raster motion.

Ink is contained in an ink reservoir 28 under pressure. In the nonprinting state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of print head 16 by an ink channel device 30. The ink preferably flows through slots and/or holes etched through a silicon substrate of print head 16 to its front surface, where a plurality of nozzles and heaters are situated. With print head 16 fabricated from silicon, it is possible to integrate heater control circuits 14 with the print head.

Figure 2A:
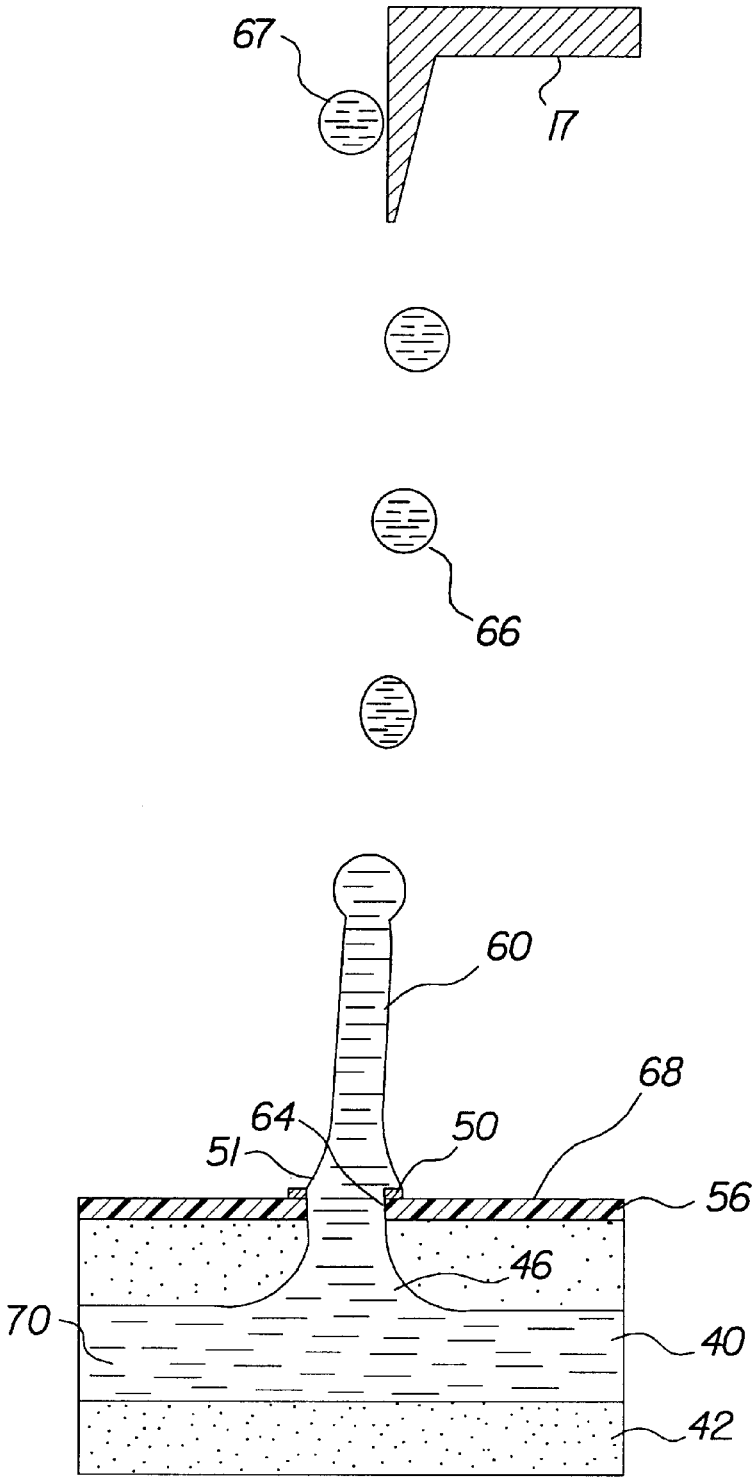
FIG. 2(A) shows a cross section of a nozzle with asymmetric heating deflection.

FIG. 2(A) is a cross-sectional view of one nozzle tip of an array of such tips that form continuous ink jet print head 16 of FIG. 1 according the above-cited co-pending application. An ink delivery channel 40, along with a plurality of nozzle bores 46 are etched in a substrate 42, which is silicon in this example. Delivery channel 40 and nozzle bores 46 may be formed by anisotropic wet etching of silicon, using a p+etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to a periodic heat pulse supplied by a heater 50.

Figure 2B:
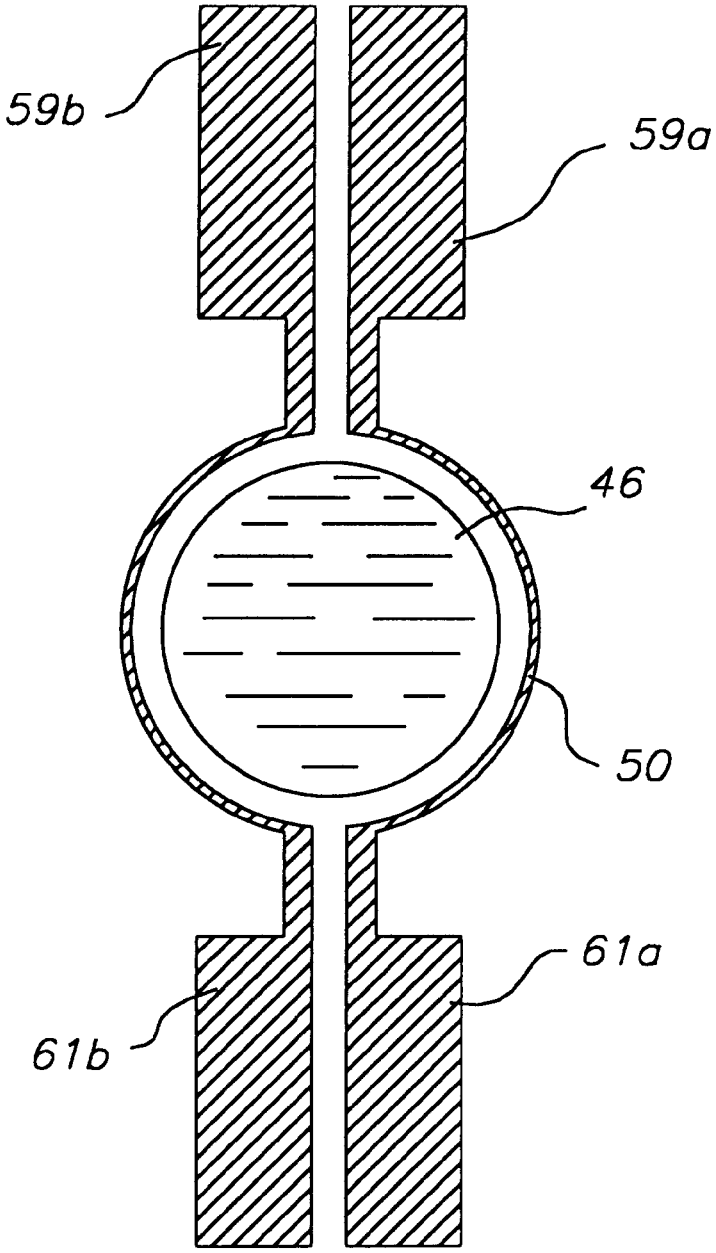
FIG. 2(B) shows a top view of the nozzle with asymmetric heating deflection.

Referring to FIG. 2(B), the heater of the above-cited co-pending application has two sections, each covering approximately one-half of the nozzle perimeter. Power connections 59*a* and 59*b* and ground connections 61*a* and 61*b* from the drive circuitry to heater annulus 50 are also shown. Stream 60 may be deflected by an asymmetric application of heat by supplying electrical current to one, but not both, of the heater sections. With stream 60 being deflected, drops 66 may be blocked from reaching recording medium 18 by a cut-off device such as an ink gutter 17. In an alternate printing scheme, ink gutter 17 may be placed to block un-deflected drops 67 so that deflected drops 66 will be allowed to reach recording medium 18.

The heater was made of polysilicon doped at a level of about thirty ohms/square, although other resistive heater material could be used. Heater 50 is separated from substrate 42 by thermal and electrical insulating layers 56 to minimize heat loss to the substrate. The nozzle bore may be etched allowing the nozzle exit orifice to be defined by insulating layers 56. The layers in contact with the ink can be passivated with a thin film layer 64 for protection. The print head surface can be coated with a hydrophobizing layer 68 to prevent accidental spread of the ink across the front of the print head.

Figure 3:
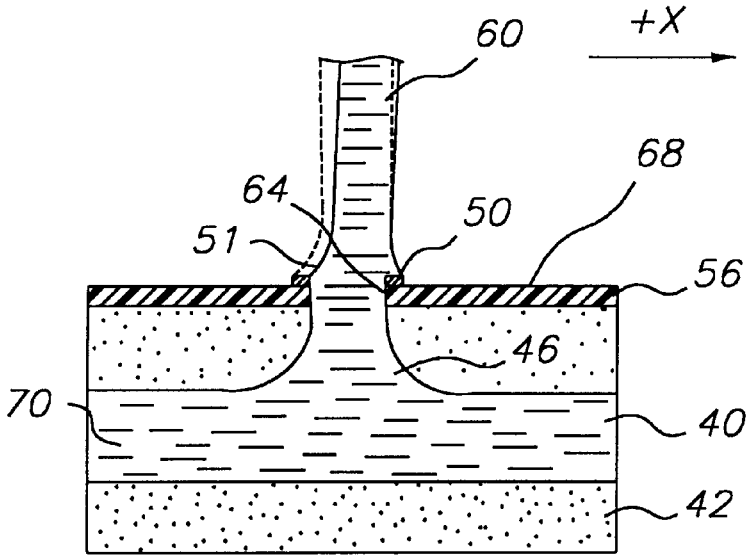
FIG. 3 is an enlarged cross section view of the nozzle with asymmetric heating deflection.

FIG. 3 is an enlarged view of the nozzle area of the above-cited co-pending application. A meniscus 51 is formed where the liquid stream makes contact with the heater edges. When an electrical pulse is supplied to one of the sections of heater 50 (the left-hand side in FIG. 3), the contact line that is initially on the outside edge of the heater (illustrated by the dotted line) is moved inwards toward the inside edge of the heater (illustrated by the solid line). The other side of the stream (the right-hand side in FIG. 3) stays pinned to the non-activated heater. The effect of the inward moving contact line is to deflect the stream in a direction away from the active heater section (left to right in FIG. 3 or in the +x direction). At some time after the electrical pulse ends the contact line returns toward the outside edge of the heater.

It is also possible to achieve drop deflection by employing a nozzle with a heater surrounding only one-half of the nozzle perimeter. The quiescent or non-deflected state utilizes pulses of sufficient amplitude to cause drop breakup, but not enough to cause significant deflection. When deflection is desired, a larger amplitude or longer width pulse is applied to the heater to cause a larger degree of asymmetric heating.

Parameters Affecting Angle of Deflection

Figure 4:
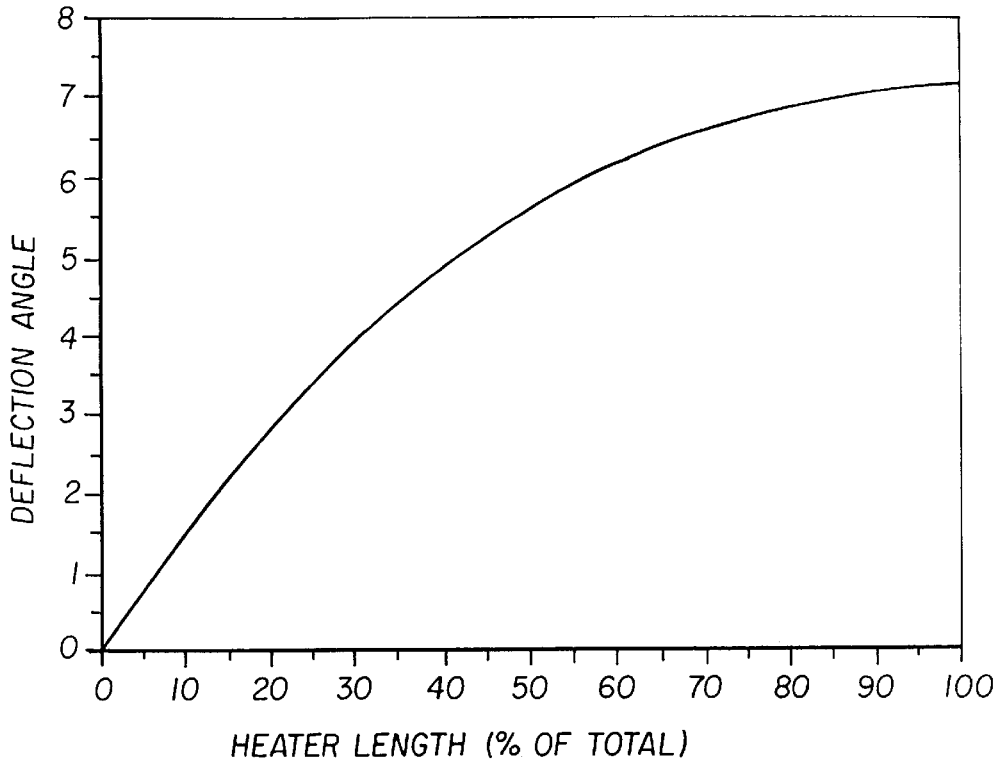
FIG. 4. is a graph showing that as the length of a section of a heater is increased, the angle of deflection increases.
Figure 5:
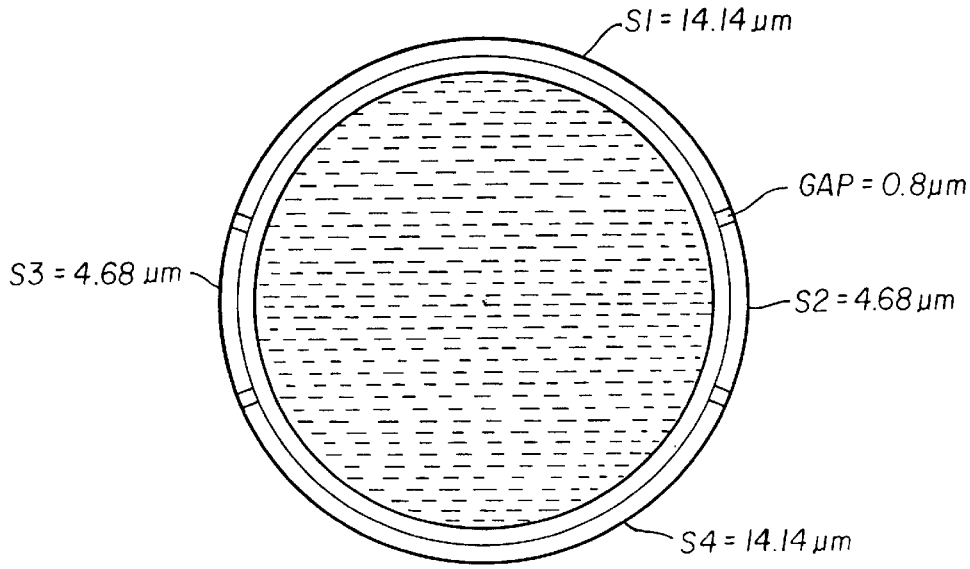
FIG. 5 is a view into the opening of a nozzle such that ink droplets come out of the page.

In accordance with the present invention, it has been discovered that the angle of deflection of the stream or of the droplets is unexpectantly varied by selectively adjusting the length of the heater that is powered. FIG. 4 shows that as the length of a section of the heater is increased, the angle of deflection increases. FIG. 5 is derived from nozzles whose heaters lengths varied from zero (0% of possible length) to one-half of the nozzle circumference (100% of possible length). Assuming a constant heater resistance and a constant current level, then the stream deflection is initially linearly related to the heater length and saturates as the length approaches one-half of the circumference.

Figure 6:
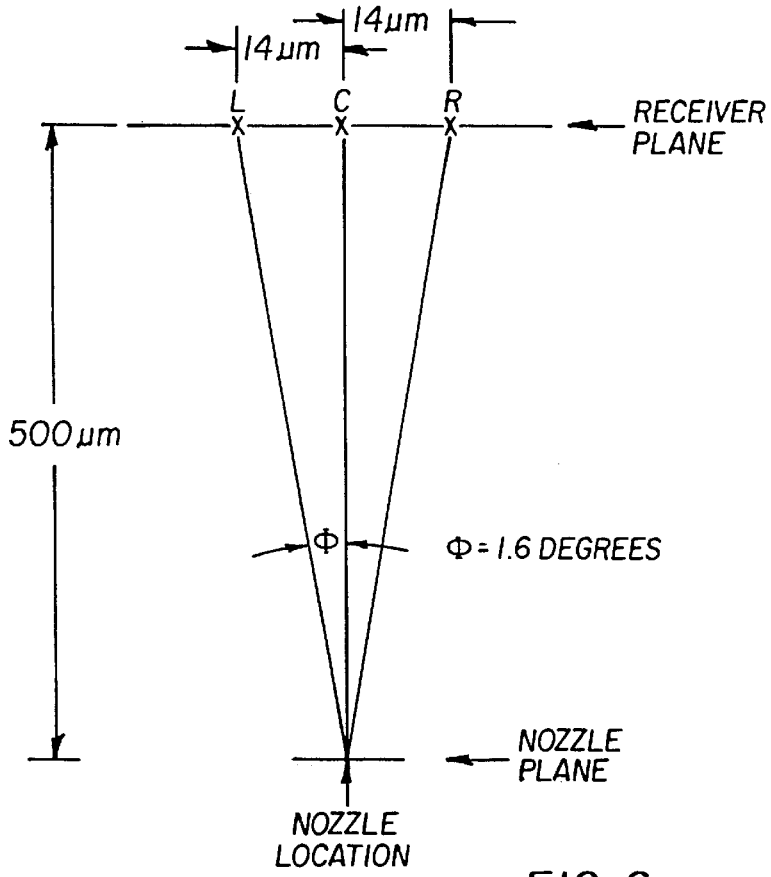
FIG.6 is a view of possible ink paths from the side of the nozzle of FIG. 5.

FIG. 5 is a view into the opening of a nozzle such that ink droplets come out of the page. FIG. 6 is a view of possible ink paths from the side of the nozzle of FIG. 5. The perimeter about the nozzle bore is divided into four segments S1–S4, with gaps between the adjacent segments. The dimensions shown in the drawings are representative of a preferred embodiment of the present invention, and are not intended to exclude other forms of the invention. Segment S4 may be a heater segment or a non-heater segment. By segmenting the heater as illustrated, it is possible to direct the droplets to land in three adjoining locations L, C, and R shown in FIG. 6. It is possible to print a spot at "R" right of center by activating heater segments S1 and S3 of FIG. 5, a spot at "C" in the center by activating only heater segments S1, and a spot at "L" left of center by activating heater segments S1 and S2. In the illustrated embodiment, locations "L", "C", and "R" are separated by 14 $\mu$m, which is the spot separation for 1800 dot per inch (dpi) density. Typically the receiver moves continually underneath the print head and the three dots are fired sequentially in time.

Figure 7:
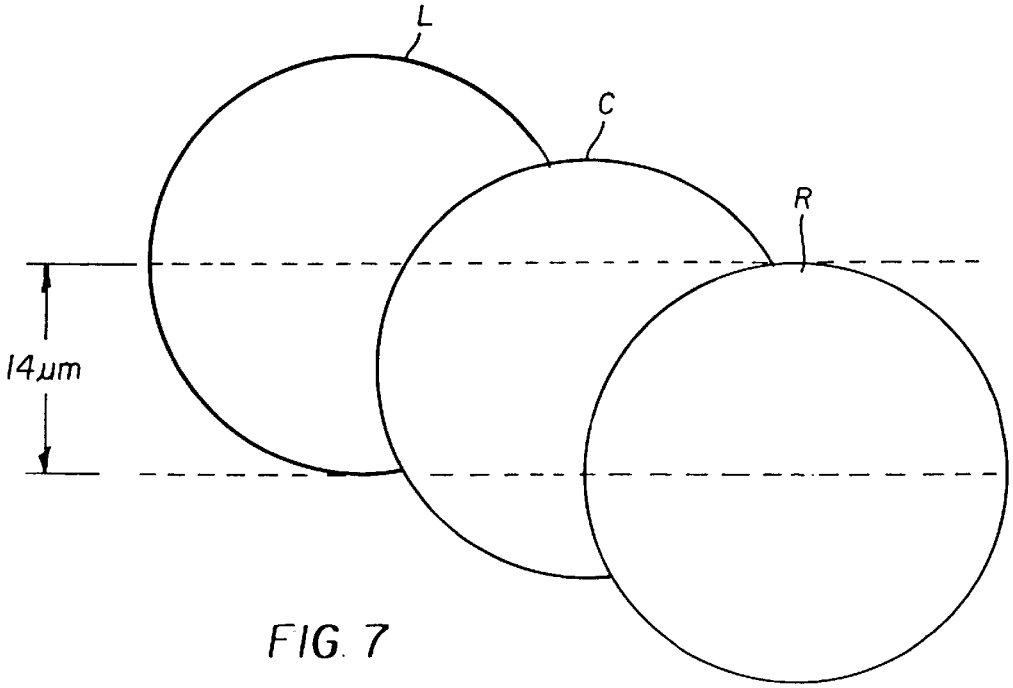
FIG. 7 shows relative locations of droplets from a single nozzle.

Assuming that the receiver moves at about 100 $\mu$s per line, with the line width being 14 $\mu$m and that the drops can be steered at the rate of about 30 kHz, then the three spots on the line will be arranged as shown in FIG. 7. The misplacement of the spots from the center of the line is far less than can be seen by the eye.

The advantage of such a print head is that it has one-third less nozzles than the number of adjacent spots it can write on the receiver. For example, if it has 600 nozzles per inch, it can write at 1800 spots per inch. The lower density of nozzles will increase the fabrication yield, because there are fewer nozzles and less circuitry to build, thus decreasing the average cost of the print head. The print head will be more reliable, as well, because the nozzles are far apart and any contamination that may accumulate around a nozzle will not easily affect the operation of an adjacent one.

Redundancy, Defect Correction, Averaging

Figure 8:
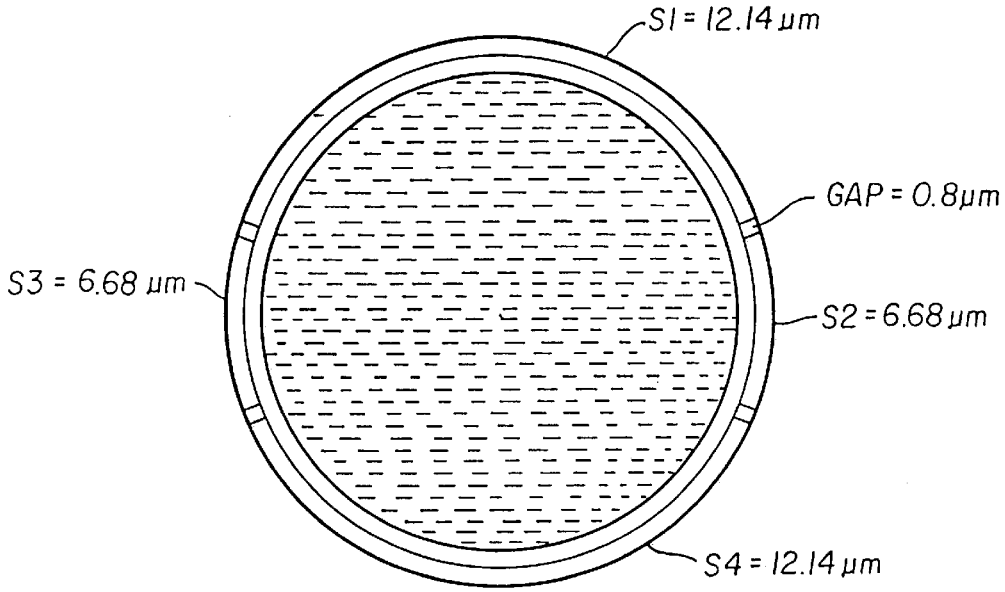
FIG. 8 is a view into the opening of a nozzle such that ink droplets come out of the page.
Figure 9:
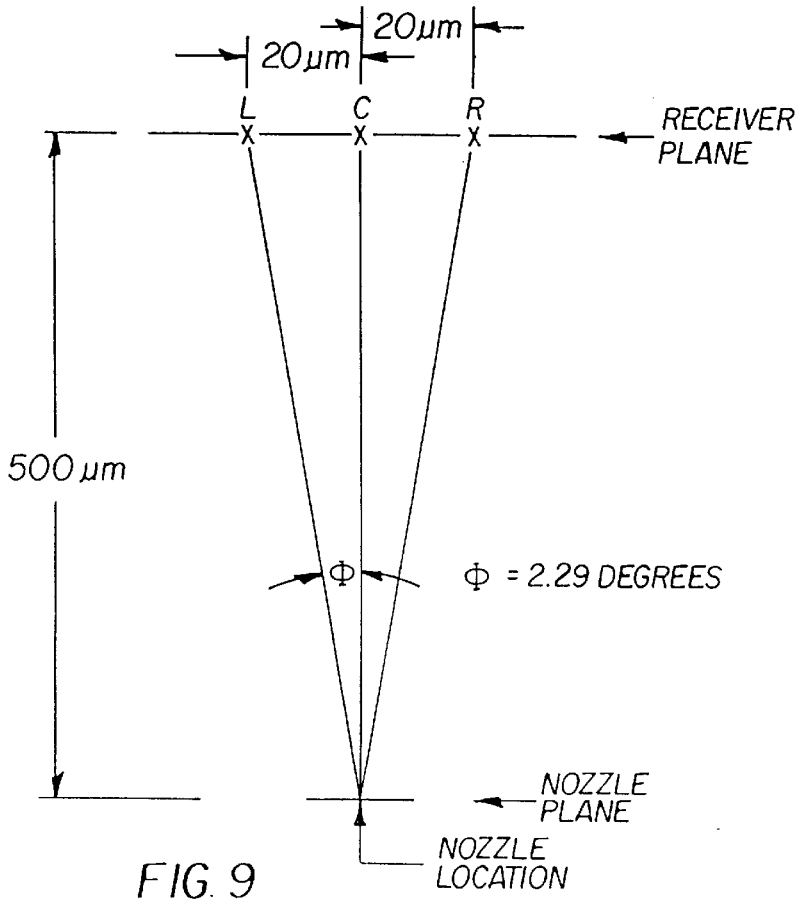
FIG. 9 is a view of possible ink paths from the side of the nozzle of FIG. 8.

Since the full width print heads discussed here are made using VLSI equipment and processes that are capable of submicron geometries, it is possible to incorporate redundancy. For example, the design of a print head that must print at 1200 dpi drop placement could have nozzles placed also at 1200 dpi spacing. Assuming that each nozzle has a segmented heater as shown in FIG. 8 and the receiver is 500 $\mu$m away from the surface of the print head, as shown in FIG. 9, nozzle spacing is 20 $\mu$m and, for a 12 $\mu$m nozzle diameter and 30 kHz rate of droplet fonnation, the droplet diameter in the air is about 20 $\mu$m. If the droplets spread to twice their diameter in the air when they hit the paper, then the droplets will overlap by about 50% on the paper.

It is possible that one or more nozzles may become plugged either during fabrication of the print head or during operation. Or, a nozzle's heater may be electrically open circuited so that the droplets cannot be deflected away from the gutter and onto the paper. If the defective nozzle is not adjacent to two non-working nozzles, then one of the nozzles adjacent to the one that is not working can be used to deposit the ink drop in its place.

A penalty of about 33 $\mu$s per line in printing time may be paid, compared to the case where all 1200 nozzles are operational and redundancy is not evoked. For a six inch page length, at 1200 dpi, there are 7200 lines. Thus the total printing time increase per page will be about 0.25 seconds. However, there is a limit to how fast a line can be printed, because of the time required for a droplet to dry enough before an adjacent droplet is deposited. Thus the loss in printing speed may in fact be less than the 0.25 seconds per page calculated above.

In a different scenario, a defect may occur during the fabrication process that causes the direction of the stream exiting a particular nozzle to be such that it bypasses the gutter. Then, the appropriate segments of that particular heater may be connected permanently to a power source so that the stream is directed to hit the gutter. This effectively disables that particular nozzle. Adjacent nozzles will then be used to print in the location the defective nozzle would have been printing, as shown in FIG. 9. Thus, the segmented heater option can be used to improve the print head fabrication yield.

Besides redundancy and defect correction, the present invention can be utilized to enhance image quality. Assume a 1200 dpi print head printing at the same resolution. It is conceivable that nearby nozzles do not produce the exact same size droplets. Since each location in the receiver can be addressed by three adjoining nozzles, it is advantageous that each of the nozzles deposits a droplet at each location, assuming of course that that location needs to be printed, so that the resulting amount of ink deposited at each location is the sum of the three droplets. This way an averaging occurs, and variations in droplet size of adjacent nozzles is minimized.

Conclusions

It has been shown that the segmented heater concept can be utilized to reduce the cost of print heads and increase their reliability. It can also increase the apparent fabrication yield, extend the operating life of a print head by invoking the built-in redundancy and it can be used to improve image quality in graphic arts systems by offering fine drop placement adjustment.

The invention has been described in detail with particular reference to preferred embodiments thereof, but it will be understood that variations and modifications can be effected within the spirit and scope of the invention.

What is clained is:

1. Apparatus for controlling ink in a continuous ink jet printer in which a continuous stream of ink is emitted from a nozzle; said apparatus comprising:

an ink delivery channel;

a source of pressurized ink communicating with the ink delivery channel;

a nozzle bore perimeter defining a nozzle bore which opens into the ink delivery channel to establish a continuous flow of ink in a stream;

a heater having a plurality of selectively independently actuated sections which are positioned along respectively different portions of the nozzle bore perimeter; and an actuator adapted to selectively activate none, one, or a plurality of said heater sections such that:

actuation of heater sections associated with only a portion of the entire nozzle bore perimeter produces an asymmetric application of heat to the stream to control the direction of the stream between a print direction and a non-print direction, and simultaneous actuation of different numbers of heater sections associated with only a portion of the entire nozzle bore perimeter produces corresponding different asymmetric application of heat to the stream to thereby control the direction of the stream between one print direction and another print direction.

2. Apparatus as set forth in claim 1, further comprising an ink gutter in the path of the ink stream traveling in only said non-print direction.

3. Apparatus as set forth in claim 1, wherein substantially the entire bore perimeter is associated with a respective heater section.

4. Apparatus as set forth in claim 1, wherein only a portion of the entire bore perimeter is associated with a respective heater section.

5. Apparatus as set forth in claim 1, wherein substantially the heater segments are of two different lengths.

6. Apparatus as set forth in claim 1, wherein the ink stream travels in the non-print direction when none of the heater sections is activated.

7. A print head having a plurality of spaced apart nozzles for delivering ink droplets to a receiver at a resolution three times the spacing of the nozzles; said apparatus comprising:

an ink delivery channel;

a source of pressurized ink communicating with the ink delivery channel;

a nozzle bore perimeter defining a nozzle bore which opens into the ink delivery channel to establish a continuous flow of ink in a stream;

a heater having selectively independently actuated sections which are positioned along the nozzle bore perimeter; and an actuator adapted to selectively activate the heater sections such that the stream is selectively directed:

in a non-print direction, in a first print direction, in a second print direction, and in a third print direction between the first and second print directions.

8. A print head as defined in claim 7, wherein:

the heater has three selectively independently actuated sections which are positioned along respectively left, center, and right portions of the nozzle bore perimeter; and the actuator is adapted to selectively activate no heater section, the left and center heater sections simultaneously, the center heater section alone, and the center and right heater sections simultaneously such that:

actuation of no heater section directs the stream in the non-print direction, simultaneous actuation of the left and center heater sections directs the stream in the first print direction, simultaneous actuation of the center and right heater sections directs the stream in the second print direction, and actuation of the center heater section alone directs the stream in the third print direction between the first and second print directions.

9. A print head for delivering ink droplets to a receiver at a predetermined resolution; said apparatus comprising:

an ink delivery channel;

a source of pressurized ink communicating with the ink delivery channel;

a plurality of nozzle bores, defined by nozzle bore perimeters, which open into the ink delivery channel to establish a continuous flow of ink in a stream from each nozzle bore, said nozzle bores being spaced apart from left to right in accordance with the predetermined resolution, each nozzle bore having:

a heater having selectively independently actuated sections which are positioned along the nozzle bore perimeter; and an actuator adapted to selectively activate the heater sections such that the stream from a given nozzle bore is selectively directed:

in a non-print direction, in a first print direction to produce a spot on the receiver aligned with the nozzle bore adjacent to one side of the given nozzle bore, in a second print direction to produce a spot on the receiver aligned with the nozzle bore adjacent to the other side of the given nozzle bore, and in a third print direction to produce a spot on the receiver aligned with the given nozzle.

10. A print head as defined in claim 9, wherein:

the heater has three selectively independently actuated sections which are positioned along respectively left, center, and right portions of the nozzle bore perimeter; and the actuator is adapted to selectively activate no heater section, the left and center heater sections simultaneously, the center heater section alone, and the center and right heater sections simultaneously such that:

actuation of no heater section directs the stream in the non-print direction, simultaneous actuation of the left and center heater sections directs the stream in the first print direction, simultaneous actuation of the center and right heater sections directs the stream in the second print direction, and actuation of the center heater section alone directs the stream in the third print direction between the first and second print directions.

11. A print head having a plurality of spaced apart nozzles for delivering ink droplets to a receiver; said apparatus comprising:

an ink delivery channel;

a source of pressurized ink communicating with the ink delivery channel;

a nozzle bore perimeter defining a nozzle bore which opens into the ink delivery channel to establish a continuous flow of ink in a stream;

a heater having selectively independently actuated sections which are positioned about the nozzle bore perimeter; and an actuator adapted to selectively permanently activate an appropriate heater section such that permanent activation of the heater section directs the stream in a non-print direction, whereby a nozzle bore can be effectively disabled if it becomes defective.

12. A print head having a plurality of spaced apart nozzles for delivering ink droplets to a receiver at a resolution three times the spacing of the nozzles; said apparatus comprising:

an ink delivery channel;

a source of pressurized ink communicating with the ink delivery channel;

a nozzle bore perimeter defining a nozzle bore which opens into the ink delivery channel to establish a continuous flow of ink in a stream;

a heater having four selectively independently actuated sections which are positioned about the nozzle bore perimeter; and an actuator adapted to selectively activate no heater section, first and second heater sections simultaneously, the second heater section alone, the second and third heater sections simultaneously, and the fourth heater section such that:

simultaneous actuation of the first and second heater sections directs the stream in the first print direction, simultaneous actuation of the second and third heater sections directs the stream in the second print direction, actuation of the second heater section alone directs the stream in the third print direction between the first and second print directions, and actuation of the fourth heater section directs the stream in the non-print direction, whereby a nozzle bore can be effectively disabled if it becomes defective.

13. A process for controlling ink in a continuous ink jet printer in which a continuous stream of ink is emitted from a nozzle; said apparatus comprising:

establishing a continuous flow of ink in a stream;

asymmetrically applying heat to the stream to control the direction of the stream between a print direction and a non-print direction, and differentially asymmetrically applying heat to the stream to thereby control the direction of the stream between one print direction and another print direction.

* * * * *